United States Patent [19]

Magiera

[11] 3,977,677

[45] Aug. 31, 1976

[54] BOARD GAME APPARATUS

[75] Inventor: David L. Magiera, Bloomington, Minn.

[73] Assignee: Wicks & Nemer, P.A., Minneapolis, Minn.

[22] Filed: May 29, 1975

[21] Appl. No.: 581,946

[52] U.S. Cl. ..... 273/134 D; 273/134 G; 273/134 GB; 273/146

[51] Int. Cl.[2] ..... A63F 3/00

[58] Field of Search ..... 273/131, 134, 136

[56] References Cited

UNITED STATES PATENTS

| | | | |
|---|---|---|---|
| 621,799 | 3/1899 | Degges | 273/131 B |
| 1,336,169 | 4/1920 | Stewart | 273/131 B |
| 2,133,515 | 10/1938 | Horton | 273/131 K |
| 3,427,027 | 2/1969 | Kenyon | 273/134 C |
| 3,759,520 | 9/1973 | Straitwell | 273/134 AD |

*Primary Examiner*—Delbert B. Lowe
*Attorney, Agent, or Firm*—Wicks & Nemer

[57] ABSTRACT

Board game apparatus is shown, in its preferred form, as including a game board having at least two game playing portions thereof interconnected by a common "neutral" portion. Further included are first and second chance taking apparatus for determining movement of the players' game markers, including a defending pawn and an attack knight, within the game playing portions.

12 Claims, 4 Drawing Figures

118
117 116 115 114 113 112
111 110 109 108 107 106 105
104 103 102 101 100 99 98
97 96 95 94 93 92 91
90 89 88 87 86 85 84
83 82 81 80 79 78 77
76 75 74 73 72 71 70
12
10
129
28
30
126
20
18
70 71 72 73 74 75 76
77 78 79 80 81 82 83
84 85 86 87 88 89 90
91 92 93 94 95 96 97
98 99 100 101 102 103 104
105 106 107 108 109 110 111
112 113 114 115 116 117
118
23
24
25
26
122
124
22
120

14
16
127
128

BOARD GAME APPARATUS

BACKGROUND

The present invention relates generally to a board game, and more particularly to a board game including chance.

With the increasing amounts of leisure time available to persons generally in modern society, an increasing need has been felt for amusement devices to occupy such leisure time. A selected class of such amusement devices has been generally favored as providing substantial nonrepetitive play, requiring logic and intelligent decision making during play, and generally maintaining a high degree of interest for an extended period of time. Board games are within this selected class.

SUMMARY

A preferred embodiment of the present invention includes a game board including at least a first and a second game playing portion interconnected together by a common portion. Each game playing portion includes a plurality of connected locations forming a game movement area. Each player has an associated first and second form of game markers for movement within the game movement areas determined by chance taking apparatus.

It is thus a primary object of the present invention to provide a novel board game apparatus.

It is further an object of the present invention to provide such apparatus for allowing the play of a board game including chance.

These and further objects and advantages of the present invention will become clearer in light of the following detailed description of an illustrative embodiment of this invention described in connection with the drawings.

DESCRIPTION

Figures 1, 2, 3, 4:
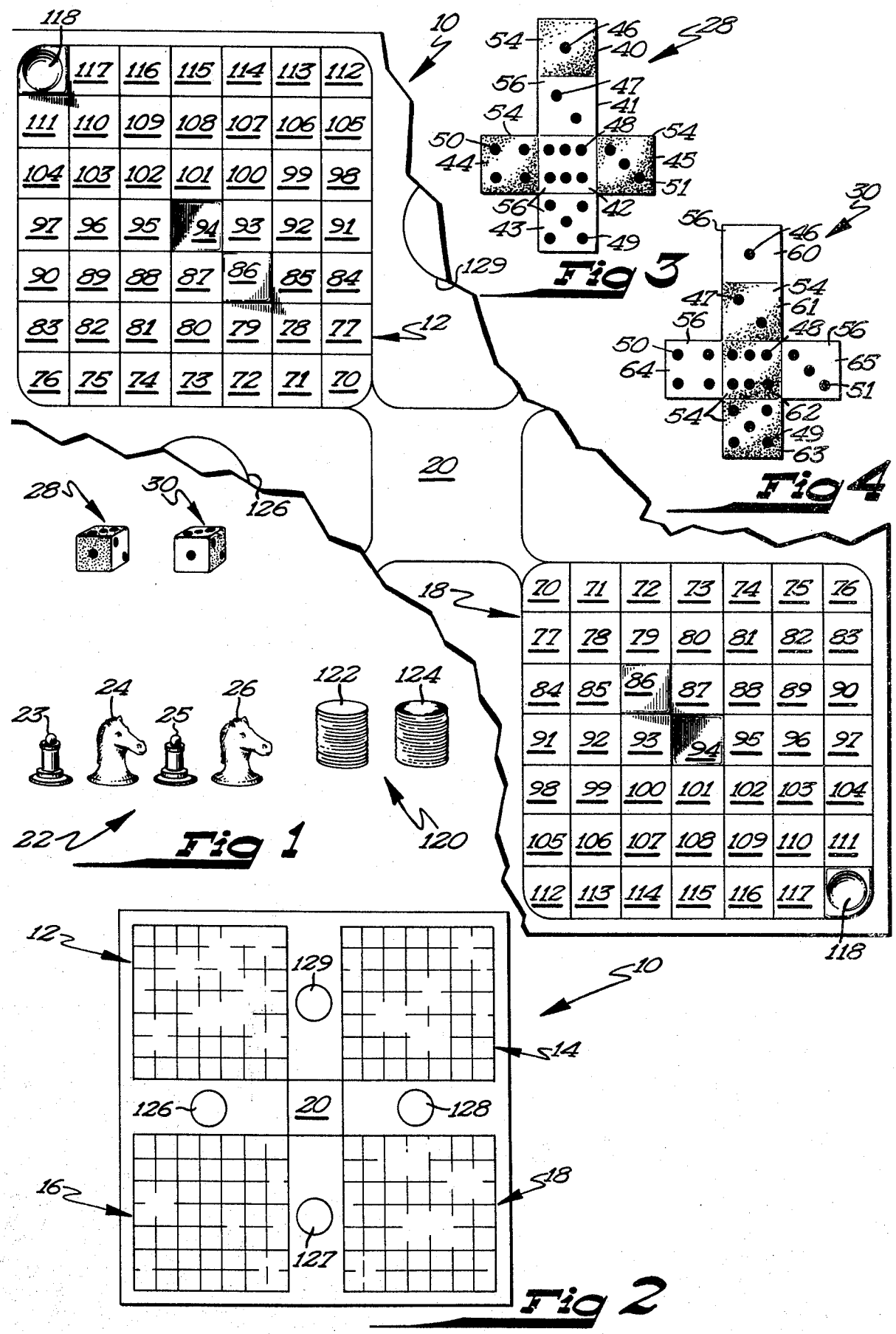
FIG. 1 shows a partial, top plan view of a game board according to the present invention, including perspective views of various of the remaining apparatus for play of the board game.
FIG. 2 shows a top plan view of a game board according to the present invention.
FIGS. 3 and 4 show planar views of three-dimensional objects forming a part of the present invention as shown in FIG. 1.

In FIG. 2, a game board used in the board game apparatus of the present invention is shown and generally designated 10. Game board 10 includes a first game playing portion 12, a second game playing portion 14, a third game playing portion 16, and a fourth game playing portion 18. Game playing portions 12, 14, 16, and 18 are interconnected together by a common, "neutral", interconnection portion 20 located between portions 12, 14, 16, and 18, and interconnecting, in the preferred embodiment, portions 12, 14, 16, and 18 at their corners.

FIG. 1 shows an enlarged view of game playing portions 12 and 18 and common portion 20. Also shown in FIG. 1 are a plurality of individual playing pieces, generally designated 22 shown as situated adjacent to board 10. Pieces 22 include separate playing pieces 23, 24, 25, and 26, which may be items specifically related to rules of the game, as shown, or any other items which can be separately identifiable.

The board game apparatus further includes a first chance taking apparatus 28, shown in its first preferred form as a die, and a second chance taking apparatus 30, also shown in its first preferred form as a die.

First chance taking apparatus 28 is also generally shown in FIG. 3 as a die. Die 28 is cubical in shape including six outer faces 40–45. Generally, die 28 is used for randomly picking a member from a third set of identifiable members. The third set is formed from the combination of members of a first and a second set. Generally, the first set comprises a plurality of separately identifiable members 46–51, such as a series of dots as conventionally formed on dice, as shown, numerals, or similar members located on faces 40–45, respectively. The second set includes at least two separately indentifiable members which are further separately identifiable from the members of the first set. In the preferred embodiment, the second set consists of either rough members 54 or smooth members 56.

Therefore, the third set of the preferred embodiment, as applied to die 28, includes the following members: a rough one dot separately identifiable member, a smooth two dot separately identifiable member, a rough three dot separately identifiable member, a rough four dot separately identifiable member, a smooth five dot separately identifiable member, and a smooth six dot separately identifiable member.

Second chance taking apparatus 30 is generally shown in FIG. 4 as a die. Die 30 is cubical in shape including six outer faces 60–65. Generally, die 30 is used for randomly picking a member from a fourth set of identifiable members. The fourth set is formed from the combination of members of a first and second set. Generally, the first set comprises a plurality of separately identifiable members 46–51, such as a series of dots as conventionally formed on dice, as shown, numerals, or similar members located on faces 60–65, respectively. The second set includes at least two separately identifiable members which are further separately identifiable from the members of the first set. In the preferred embodiment, the second set consists of either rough members 54 or smooth members 56.

Therefore, the fourth set of the preferred embodiment, as applied to die 30, includes the following members: a smooth one dot separately identifiable member, a rough two dot separately identifiable member, a smooth three dot separately identifiable member, a smooth four dot separately identifiable member, a rough five dot separately identifiable member, and a rough six dot separately identifiable member.

It should be noted that both the third and fourth sets are formed from the combination of a member of the first set and a member of the second set. However, the third set is the complement of the fourth set such that the intersection of the third set and the fourth set is an empty set, or in other words, the third and fourth sets have no members in common.

By rolling die 28, the member indicated by the vertically facing face on die 28 is the randomly chosen member of the third set. In a similar manner, by rolling die 30, the member indicated by the vertically facing face on die 30 is the randomly chosen member of the fourth set.

As best seen in FIG. 2, game playing portions 12, 14, 16, and 18 include a plurality of connected locations 70–118 arranged on game board 10 forming a game movement area. In the preferred embodiment, game playing portions 12, 14, 16, and 18 are square in shape and locations 70–118 are arranged in a grid pattern type arrangement and may be of the checkerboard type. In the preferred embodiment, portion 20 interconnects locations 70 of portions 12, 14, 16, and 18, respectively.

In the preferred embodiment, location 86 or the "pawn base" location of each portion 12, 14, 16, and 18 is separately identifiable from each and every other location 70–85 and 87–118. For example, in the preferred embodiment, location 86 of each portion 12, 14, 16, and 18 is raised above the remaining locations 70–85, and 87–118.

Similarly, location 94 or the "knight base" location of each portion 12, 14, 16, and 18 is separately identifiable from each and every other location 70–93 and 95–118. For example, in the preferred embodiment, location 94 of each portion 12, 14, 16, and 18 is depressed below the remaining locations 70–93 and 95–118.

Likewise, location 118 or the "fortress" location of each portion 12, 14, 16, and 18 is separately identifiable from each and every other location 70–117. For example, in the preferred embodiment, location 118 of each portion 12, 14, 16, and 18 is raised above the remaining locations 70–117 and has a concave depression formed in the top surface thereof.

The game apparatus further includes a plurality of game chips, token treasure, or game reward members, generally designated 120. Chips 120 include separate chip stacks 122 and 124, which may be items specifically related to the rules of the game, or any other items which can be separately identifiable.

Game board 10 further includes treasure storage areas 126–129 associated with each game portion 12, 16, 18, and 14, respectively, for placement of chips 120 of the associated player.

The objective of the board game apparatus of the present invention is to capture the chips 120 of the other players, while avoiding the capture of your own, by movement of game markers 22 on the game board 10.

Each player is given a stack of chips such as stacks 122 and 124 as shown in FIG. 1 which the player places in his associated area 126–129. Each player is assigned playing pieces 22 such as playing pieces 23 and 24, or pieces 25 and 26 as shown in FIG. 1. Playing pieces 23 and 25 shown as defending pawns are placed on pawn base location 86 of the portion 12, 14, 16, or 18 associated with an individual player. Playing pieces 24 and 26, shown as a knight, are placed on knight base location 94 of the portion 12, 14, 16, or 18 associated with the individual player.

Pawns 23 and 25 are designed to protect the players fortress location 118, whose purpose will be explained further hereinafter. Pawns 23 and 25 cannot move outside portion 12, 14, 16, or 18 associated with the individual player. Pawns 23 and 25 may move in the two perpendicular directions, parallel to both sides of the board, but may not move diagonally, Pawns 23 and 25 may jump over another piece while moving from one location to another. Pawns 23 and 25 may "capture" another piece by landing exactly on the location occupied by the opposing piece.

Knights 24 and 26 are designed to attack the opposing player, whose purpose will be explained further hereinafter. Knights 24 and 26 can move in any portion

12, 14, 16 and 18 and may move in the two perpendicular directions parallel to both sides of the board, but may not move diagonally. However if knights 24 and 26 move through the common portion 20 after taking two directional moves in one of the portions 12, 14, 16, and 18 and still has dice roll numbers to use, knights 24 and 26 may move in two additional directions once entering the other portions 12, 14, 16, and 18. In order to land in the common portion 20, knights 24 and 26 must land therewithin exactly on the count of one or both of the dice roll numbers.

The first player, assumed for the purpose of this description to have been assigned playing pieces 23 and 24, is then ready to begin play. The player must first call his dice throw by predicting the outcome of the first and second chance taking apparatus and determine which strategy of play would be best in view of the location of the various playing pieces 22 on game board 10. Possible dice throw calls are shown in the following table in reference to first chance taking apparatus 28 and second chance taking apparatus 30, shown in the preferred form as dice.

DICE THROW CALLS

1. OFFENSE

If dice 28 and 30 are both rough or both smooth, the player moves the total number of squares indicated by the total number of vertically facing dots on the dice. The player may move his knight or pawn the total, or move the knight one number and the pawn the other.

2. DEFENSE

If dice 28 and 30 are both rough or both smooth, an opponent of the player's choice is moved the total number of squares indicated by the total number of vertically facing dots on the dice. The player may move the opposing knight or the opposing pawn the total number of squares, or move the opposing knight one number and the opposing pawn the other.

3. OFFENSE ROUGH

The player moves his knight or pawn the total number of squares indicated by the total number of dots on the vertically facing rough surfaces of die 28 and 30, only.

4. DEFENSE ROUGH

The player moves an opposing knight or opposing pawn of the player's choice the total number of squares indicated by the total number of dots on the vertically facing rough surfaces of dice 28 and 30, only.

5. OFFENSE SMOOTH

The player moves his knight or pawn the total number of squares indicated by the total number of dots on the vertically facing smooth surfaces of dice 28 and 30, only.

6. DEFENSE SMOOTH

The player moves an opposing knight or opposing pawn of the player's choice the total number of squares indicated by the total number of dots on the vertically facing smooth surfaces of dice 28 and 30, only.

7. SPLIT

If one die, of the first and second dice 28 and 30, has a vertically facing rough surface and the other die has a vertically facing smooth surface, the player moves his pawn or knight the number of squares indicated by the number of dots of the vertically facing die of the player's choice and moves an opposing knight or an opposing pawn the total number of squares indicated by the number of dots of the vertical face of the other die. If both dice have the same number of vertically facing dots, the player's pawn or knight and the opposing pawn or opposing knight move the same number of squares.

8. DOUBLE SPLIT

If both dice have the same number of vertically facing dots and one die has a vertically facing rough surface and the other die has a vertically facing smooth surface, the player moves his knight 14 spaces.

After the player announces his dice throw call, he rolls dice 28 and 30 together. If the player correctly predicts the throw of dice 28 and 30, the player moves his playing pieces 23 and 24 and/or moves his opponent's playing pieces 25 and 26 according to the dice throw call set out above. However, if the player incorrectly predicts the throw of dice 28 and 30, the player must wait for his next turn to try again.

For example, if the player announces the dice throw call of "DOUBLE SPLIT", and upon rolling dice 28 and 30, both dice show three vertically facing dots and one die has a vertically facing rough surface and the other die has a vertically facing smooth surface, as shown in FIG. 1, the player moves his knight 14 spaces; however, if the dice do not show the same number of vertically facing dots, he loses his turn and the dice advances to the next player who continues play.

A player's knight can capture an opponent's knight, pawn, or fortress when the player's knight lands on a location where the opponent's knight or opponent's pawn is located or lands on the opponent's fortress on an exact die or dice count. A player's pawn can capture an opponent's knight when the player's pawn lands on a location where the opponent's knight is located on an exact die or dice count. Capture may result in winning chips 120 from the opposing player. Possible methods of capture are:

1. Capturing an opponent's knight 24 or 26 outside its home portion 12, 14, 16, or 18. The player capturing an opposing knight 24 or 26 takes one chip 120 from that opponent and the captured knight 24 or 26 is sent back to its knight base location 94.

2. Capture of a knight 24 or 26 in its own home portion 12, 14, 16 or 18. The player wins two chips 120 from the opposing player and sends the knight 24 or 26 back to its knight base location 94. The player's knight 24 or 26 remains on the location where the capture took place. However, if the knight 24 or 26 is on location 94 when captured, the player's knight 24 or 26 remains there and the captured knight 24 or 26 is moved to its fortress location 118. If the pawn 23 or 25 is occupying the fortress location 118, the knight 24 or 26 is moved to the pawn base location 86.

3. Capture of an opponent's fortress location 118. The player takes three chips 120 from the opposing player and the player's knight 24 or 26 is returned to its own knight location 94.

4. Capture of an opponent's pawn 23 or 25. The player does not receive any chips, however the opposing pawn 23 or 25 is returned to its pawn base location 86.

In the preferred embodiment, the player having one or more of his original chips 120 remaining in areas 126–129, when the remaining players have none, is the winner. In the preferred embodiment, chips 120, which are received by the players by capturing, cannot be taken away by the opposing players. When the game is over, all players count their total chips, including original and captured chips. The player with the most chips is the winner.

It should be noted that if there are three or more players, a player may lose all of his original chips 120 before the end of the game, or in other words, if two or more players have chips 120 located within areas 126–129. The player's knight 24 or 26 then becomes a "marauder", in that the knight 24 or 26 does not have any chips to protect because the player has lost all his original chips 120 and cannot lose his captured chips 120. In the preferred embodiment, a marauder knight is allowed to move in the two perpendicular directions parallel to both sides of the board and also may move diagonally as one of its directions. As a result, a marauder knight may capture other pieces in half the normal moves.

For example if a player called his dice throw "OFFENSE ROUGH" and rolled dice 28 and 30, if the vertical face of dice 28 was face 44 and the vertical face of dice 30 was face 61, a player could move his pawn 23 or 25 or knight 24 or 26 from location 118 to location 104 and then to location 100, to location 76, to location 112, to location 116 and then to location 88, or similar moves. However if the player's knight was a marauder, he could move his knight 24 or 26 in a diagonal direction also, such as to location 104 and then to location 72, to location 70, to location 114 and then to location 98, or similar moves.

Now that the basic teachings of the present invention have been explained, many extensions and variations will be obvious to one having ordinary skill in the art. For example, although four game playing portions have been shown and described for play by four persons, it will be immediately apparent to those skilled in the art that more or fewer game playing portions can be provided, to a lower limit of two, and are intended to be embraced herein as defined by the appended claims.

Thus since the invention disclosed herein may be embodied in other specific forms without departing from the spirit or the general characteristics thereof, some of which forms have been indicated, the embodiments described herein are considered in all respects illustrative and not restrictive. The scope of the invention is indicated by the appended claims, rather than by the foregoing description and all changes which come within the meaning and range of equivalency of the claims are intended to be embraced therein.

What is claimed is:

1. Game board apparatus comprising, in combination: a game board having at least a first game playing portion and a second game playing portion and a common interconnection portion located between and interconnecting the first and second game playing portions, with each of the game playing portions including a plurality of connected locations arranged on the game board forming a game movement area, and with the common interconnection portion including substantially fewer locations than the first and second game playing portions; a first form of game markers representing individual players for movement around the locations only within the game playing portion associated with the associated player; a second form of game markers representing the individual players for movement around the locations within the first and second game playing portions and the common interconnection portion; chance taking apparatus for determining the movement of the game markers within the first and second game portions and the interconnection portion on the game board during play; and means for representing game rewards associated with each player.

2. The apparatus of claim 1 wherein the game board further includes at least a first storage area and a second storage area, with the areas allowing the reward means of the associated player to be located thereon.

3. The apparatus of claim 1 wherein the locations forming the first and second game playing portions includes a first location separately identifiable from the remaining locations and associated with the first form of game markers, a second location separately identifiable from the remaining locations and from the first location and associated with the second form of game markers, and a third location separately identifiable from the remaining locations and from the first and second locations and associated with the game reward means.

4. The apparatus of claim 1 wherein the chance taking apparatus comprises in combination: a first set including a plurality of separately identifiable members, with the members of the first set providing information as to the number of locations the game markers could be moved; a second set including at least two separately identifiable members which are further separately identifiable from the members of the first set; a third set including members formed from the combination of a member of the first set and a member of a second set, a fourth set including members formed from the combination of a member of the first set and a member of the second set, with the third set and the fourth set having no members in common; first means for randomly choosing a member of the third set; and second means for randomly choosing a member of the fourth set.

5. The apparatus of claim 1 wherein the game playing portions are square in shape and the locations are arranged on the game board in a grid pattern.

6. The apparatus of claim 1 wherein the common interconnection portion includes a single location.

7. The apparatus of claim 6 wherein the common interconnection portion interconnects with only one location located in a corner of each of the game playing portions.

8. The apparatus of claim 1 wherein the apparatus further comprises a third game playing portion and a fourth game playing portion and wherein the interconnection portion is further located between and interconnecting the third and fourth game playing portions.

9. The apparatus of claim 8 wherein the game board further includes a third storage area and a fourth storage area, with the areas allowing the reward means of the associated player to be located thereon.

10. The apparatus of claim 3 wherein the first location is raised above the remaining locations, wherein the second location is depressed below the remaining locations, and wherein the third locations is raised above the remaining locations and has a concave depression formed in the top surface thereof.

11. The apparatus of claim 4 wherein the first and second means are six sided objects, the third set contains six members, the fourth set contains six members, whereby each member of the third set is formed on a side of a first means and each member of the fourth set is formed on a side of the second means.

12. The apparatus of claim 4 wherein the members of the second set are rough or smooth.

* * * * *